United States Patent [19]

Lallemand

[11] 4,314,148

[45] Feb. 2, 1982

[54] DEVICE FOR COUNTING AND DISTRIBUTING SHEETS

[75] Inventor: Jacques Lallemand, Paris, France

[73] Assignee: Societe d'Etude et de Construction d'Appareils de Precision, France

[21] Appl. No.: 109,818

[22] Filed: Jan. 7, 1980

[30] Foreign Application Priority Data

Feb. 9, 1979 [FR] France ..... 79 03290

[51] Int. Cl.[3] ..... G06M 9/02

[52] U.S. Cl. ..... 235/92 SB; 235/92 FP

[58] Field of Search ..... 235/92 SB, 92 PK, 92 FP, 235/92 DN; 271/103, 112

[56] References Cited

U.S. PATENT DOCUMENTS 3,597,594 8/1971 Evans ..... 235/92 SB 3,795,796 3/1974 Shigemori ..... 235/92 SB 3,983,367 9/1976 Kondo et al. ..... 235/92 SB 4,064,391 12/1977 Kokubo et al. ..... 235/92 SB

*Primary Examiner*—Joseph M. Thesz

*Attorney, Agent, or Firm*—George H. Gerstman

[57] ABSTRACT

The device comprises a magazine for a stack of sheets, a sheet-extracting head which can be connected to a vacuum source and is rotatably mounted on a turntable which carries a number of columns, and means for counting the number of revolutions performed by the turntable. A first safety device indicates whether the sheet-extracting head has taken more than one sheet and a second safety device checks whether the extracting head has in fact taken at least one sheet. A circular sector of the first safety device is pivotally mounted on the extracting head. The radius of the sector is equal to the distance between its geometrical axis and the cylindrical surface of the next column increased by a value between the thickness of a single sheet to be counted and the sum of thicknesses of two sheets.

10 Claims, 16 Drawing Figures

DEVICE FOR COUNTING AND DISTRIBUTING SHEETS

This invention relates to a device for counting sheets, especially banknotes or bank-bills. Said device comprises a magazine in which the sheets are placed against each other so as to form a stack, a circular turntable rotatably mounted in proximity to said magazine about an axis parallel to the plane of the sheets within the magazine, a sheet-extracting head being rotatably mounted on said circular turntable in the vicinity of the periphery of this latter about an axis parallel to that of said turntable. The device further comprises means for driving the circular turntable in rotation in a first direction, means for driving the extracting head in rotation with respect to the turntable in the other direction, and means for counting the number of revolutions performed by the circular turntable. Drilled holes are formed in an extracting face of said sheet-extracting head and can be connected to a vacuum source by means of ducts which are connected to each other and formed respectively in said extracting head, in the shaft which carries said head, in the circular turntable, and in a vacuum inlet duct formed in a stationary member which is adjacent to said turntable.

The aim of the present invention is to improve devices of this type by incorporating certain means for correcting operational faults and safety means for preventing any errors in the number of sheets distributed, although provision is nevertheless made for stopping the device if the fault-correcting means aforesaid were to prove inadequate.

To this end, the invention accordingly provides two distinctive features: on the one hand, the rotary circular turntable which is adapted to count one sheet per revolution is also adapted to carry a plurality of columns in the vicinity of its periphery. On the other hand, the counting device further comprises a first safety device for producing a signal at each revolution of the rotary turntable if and when the extracting head has taken more than one sheet, and a second safety device for checking at each revolution of the turntable whether the extracting head has in fact taken at least one sheet. Said first safety device comprises a circular sector pivotally mounted on the extracting head and having a radius equal to the distance between its geometrical axis and the cylindrical surface of the next column on the circular turntable increased by a value ranging between the thickness of a single sheet to be counted and the sum of thicknesses of two sheets. Said first safety device further comprises means for placing said sector in two stable angular end-positions with respect to the extracting head, namely a normal operating position and a multiple-extraction information position, means whereby the stable state of normal operation and the stable state of multiple extraction of said sector are checked at each revolution of the circular turntable, as well as means for restoring said sector to the stable position of normal operation after any transfer of said sector to the stable position of multiple-extraction information.

A better understanding of the invention will be gained from the following description and from the accompanying drawings in which one embodiment of a machine for distributing banknotes or bank-bills is shown by way of example, said machine being equipped with a counting device according to the invention.

Figures 1, 2:
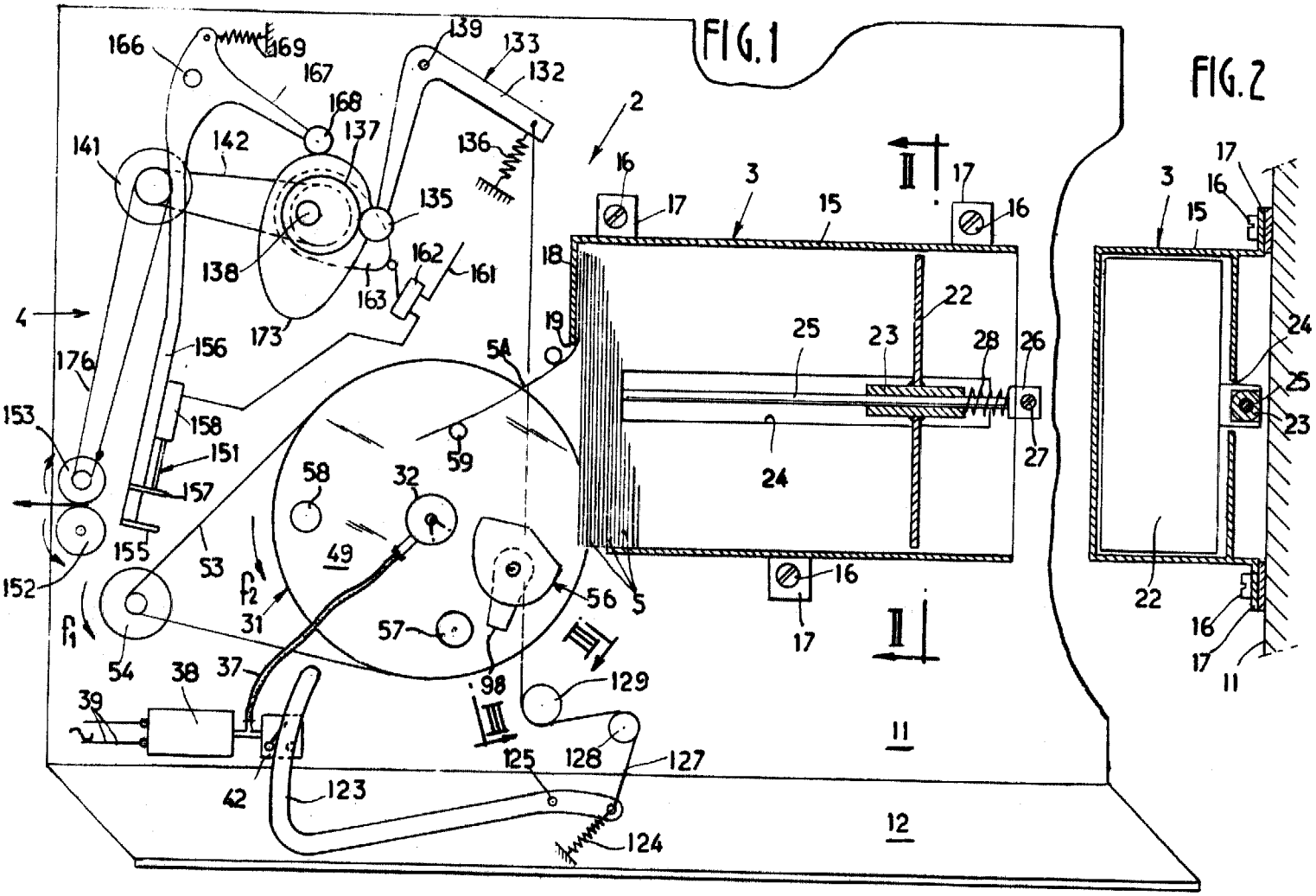
FIG. 1 is a view in side elevation showing the interior of the machine, the different elements of which are shown in their stand-by positions.
FIG. 2 is a part-sectional view of the bank-bill magazine, this view being taken along line II—II of FIG. 1.

As shown generally in FIG. 1, the machine for distributing banknotes (designated hereinafter as bank-bills) is essentially constituted by a counting device 2 with a bank-bill magazine 3 and by a bill-distributing mechanism 4.

All the components of the machine are carried by a vertical plate 11 which is rigidly fixed to a baseplate 12. The bank-bill magazine 3 is constituted by a horizontal tubular guide 15 (as also shown in FIG. 2) having a rectangular section and internal dimensions corresponding to those of the bank-bills 5 to be counted and distributed. Said guide is attached to the plate 11 by means of screws 16 which pass through lugs 17 of said guide. The bank-bills are discharged progressively as they are counted by the device 3 from that end of the guide 15 which is located on the left in FIG. 1 and which will consequently be designated as the discharge end; this end portion of the guide is partially closed by an end wall 18 which extends substantially over only the upper half of the height of said guide. That edge of said end wall which is adjacent to the open portion of the guide is rounded as shown at 19. The stack of bank-bills 5 is urged forward elastically by a pressure plate 22 having the same dimensions as those of the bank-bills and rigidly fixed to a sleeve 23. Said sleeve is capable of sliding across a longitudinally slot 24 of the guide 15 along a rod 25, one end of which is attached to one flange of a right-angle support bracket 26, the other flange of which is attached to the plate 11 by means of a screw 27. A spring 28 which is fitted over the rod 25 is applied at one end against the support bracket 26 whilst the other end of said spring is applied against the corresponding end of the sleeve 23.

Figure 3:
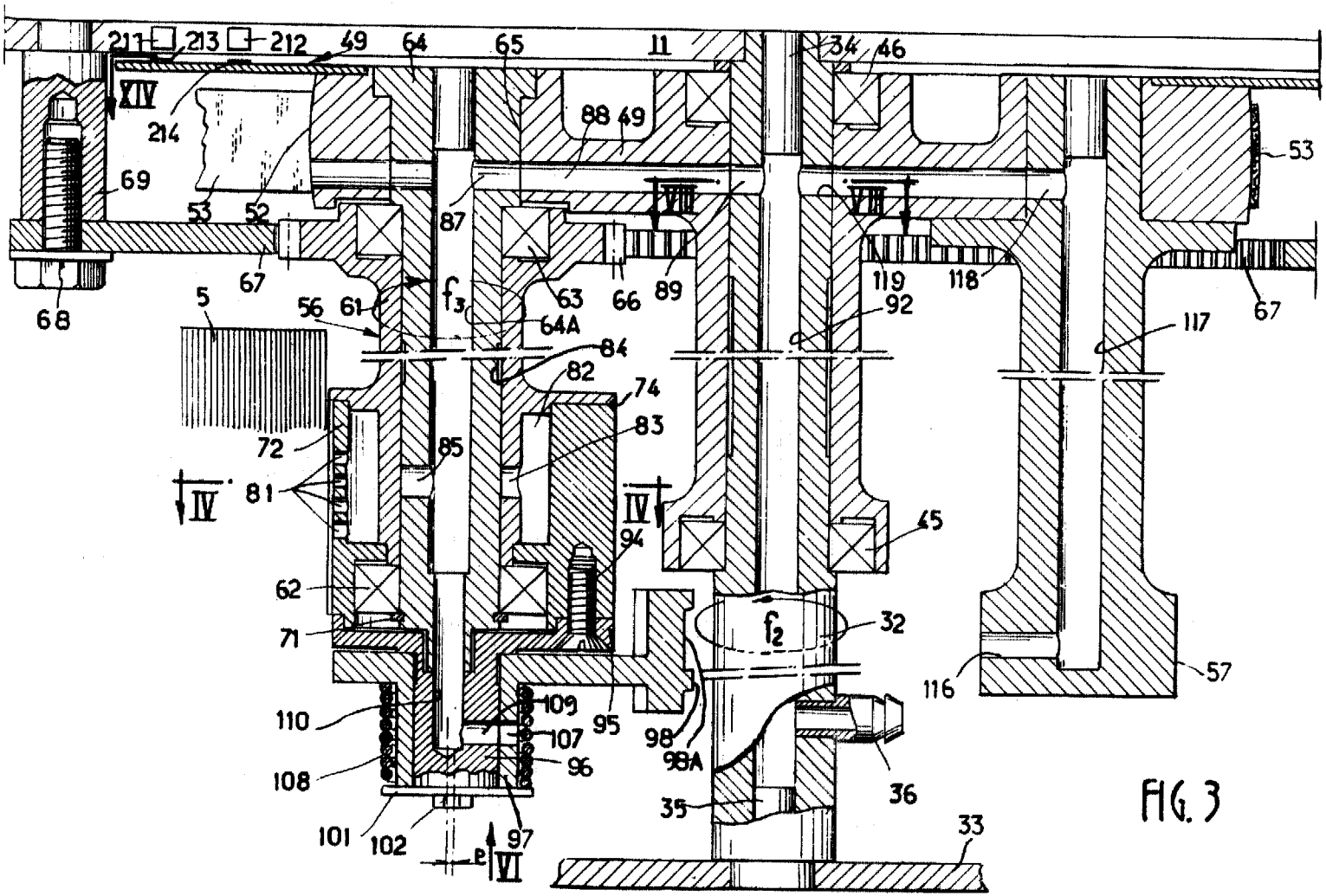
FIG. 3 is a sectional view to a larger scale along line III—III of FIG. 1 and showing in particular the detail of the circular turntable and of the extracting head.

In addition to the bank-bill magazine 3, the bill-counting device 2 comprises a counting mechanism which is generally designated by the reference numeral 31 and in fact constitutes the essential part of the entire machine. This mechanism comprises a horizontal tubular central shaft 32 (as also shown in FIG. 3). Said central shaft is rigidly fixed at both ends respectively to the plate 11 and to another plate 33 which is parallel to the plate 11 and also rigidly fixed to the base-plate 12. The shaft 32 is closed at both ends respectively by two plugs 34, 35 and that portion of said shaft which is adjacent to the plate 33 is provided with a nipple 36 for the connection of a flexible hose 37. By means of said hose, the interior of said tubular shaft can be connected to a vaccum pump 38 with an incorporated electric drive motor which is intended to be supplied from any suitable current source via an electric power line 39. An electric pressure transducer 42 is branched off the flexible hose pipe 37 and is responsive to variations in value of the partial vacuum within said pipe.

The stationary tubular shaft 32 is adapted to carry two ball bearings 45, 46 on which is mounted the hub 47 of a circular turntable 49, the periphery of which is in the form of a pulley 52. A transmission belt 53 passes over said pulley and is driven by an electric motor 54 which normally rotates in the direction of the arrow $f_1$, with the result that the normal direction of rotation of the circular turntable 49 is that of the arrow $f_2$. In the vicinity of the periphery of the circular turntable 49, and looking in the direction opposite to the arrow $f_2$, provision is made successively on said turntable for a bill-extracting head 56 and for three columns 57, 58, 59. The bill-extracting head 56 comprises a member 61 having a generally cylindrical tubular shape and supported by a shouldered tubular shaft 64 by means of two ball-bearings 62, 63. Said tubular shaft 64 is in turn engaged axially within a bore 65 of said turntable and supports a resilient snap-ring 71 for retaining the bearing 62. The head 56 is adapted to carry a pinion 66 which is disposed in meshing engagement with an internally toothed ring 67 and this latter is rigidly fixed to the stationary plate 11 by means of screws 68 and spacing columns 69. In consequence, when the circular turntable 49 rotates in the direction of the arrow $f_2$, the bill-extracting head 56 in turn rotates in the opposite direction with respect to said turntable, that is, in the direction of the arrow $f_3$. For the sake of clarity of the drawings, the pinion 66 and the toothed ring 67 have not been illustrated in FIG. 1.

Figure 4:
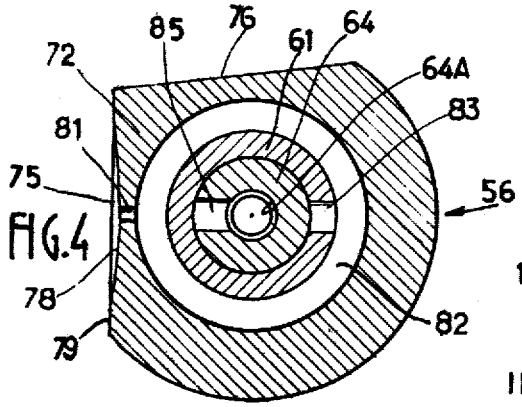
FIG. 4 is a cross-sectional view of the extracting head, this view being taken along line IV—IV of FIG. 3.
Figure 5:
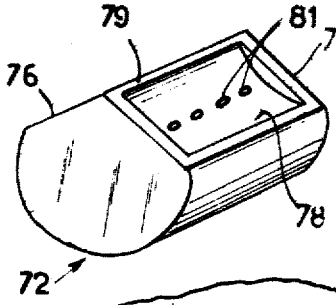
FIG. 5 is a detail view in perspective showing the bill-taking face of the extracting head.
Figure 8:
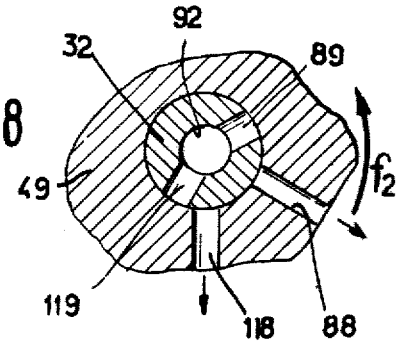
FIG. 8 is a fragmentary cross-sectional view taken along line VIII—VIII of FIG. 3 in order to show the real respective angular positions of the ducts of the circular turntable and of the switching holes of the stationary central shaft in their reference positions.

The active portion of the bill-extracting head 56 is an annular member 72 (as also shown in FIGS. 4 and 5) which is separate from the member 61 for reasons of manufacture and welded to this latter as shown at 74. The annular member 72 which also has a generally cylindrical shape is provided with two flat faces 75, 76. A hollowed-out portion 78 is formed in the flat face 75 and thus only leaves a face having the shape of a flat rectangular frame 79 for applying the extracting head against the bank-bills. Drilled holes 81 open into the bottom of said hollowed-out portion 78 and communicate with an annular chamber 82 formed between the two members 61 and 72. Said annular chamber communicates with a radial duct 83 which opens into the bore 84 of the member 61 opposite to a radial duct 85 of the tubular shaft 64. Another radial duct 87 is also formed in said tubular shaft 64 and communicates continuously with a radial duct 88 of the circular turntable 49. Said duct 88 is in turn located opposite to a radial duct 89 of the tubular shaft 32 and the bore of this latter constitutes a duct which will be designated hereinafter as the vacuum inlet duct 92.

Figure 6:
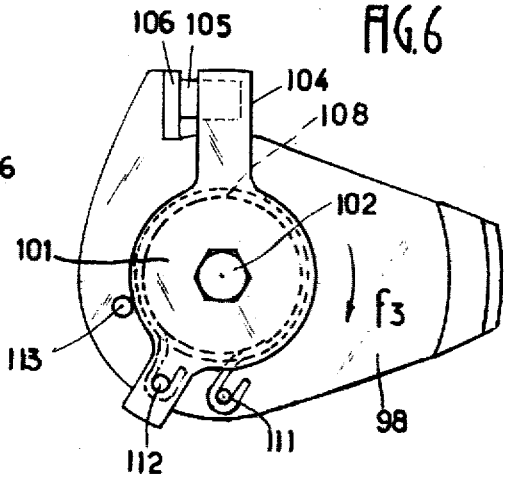
FIG. 6 is an end view of the extracting head looking in the direction of the arrow VI of FIG. 3.

The base 95 of a pivot 96 is fixed against the free end face of the annular member 72 by means of screws 94. Said pivot is displaced off-center with respect to the axis of said member 72 by a quantity "e" which is equal to 0.7 mm in this example for reasons which will become apparent hereinafter, the hub 97 of a circular sector 98 being mounted on said pivot. The radius of said circular sector is equal to the distance between its geometrical axis and the cylindrical surface of the next column 57 on the circular turntable 49, increased by a value between the thickness of a single bank-bill 5 to be counted and the sum of thicknesses of two bills. The hub 97 of the circular sector is retained axially on its pivot by means of a washer 101 which is rigidly fixed to said pivot by means of a screw 102. Said circular sector is capable of occupying two stable angular end-positions with respect to the extracting head 56, namely: the normal operating position shown in FIG. 6 and a position of information on a multiple extraction or in other words simultaneous extraction of two bank-bills or more which may arise for any reason such as, for example, the presence of pin-holes in the bank-bills, this position being shown in FIG. 7. The stable position of normal operation (FIG. 6) is ensured by means of a permanent magnet 105 which is rigidly fixed to a lug of the washer 101. Said washer is fixed on the extracting head and can be applied against a pallet 106 which is rigidly fixed to the pivoting sector 98. The multiple-extraction information position of the pivoting sector is ensured by means of a torsion spring 108 which is wound around the hub 97 of the sector. One end of said spring is attached to a stud 111 which is set in said sector whilst the other end of said spring is attached to another stud 112 of the washer 101. The amplitude of pivotal motion of the sector under the action of the spring is limited by a stop stud 113 which is rigidly fixed to the pivoting sector and intended to come into contact with the corresponding edge of the lug 112. The force of the spring 108 is lower than the contact force of the magnet 105 in order to maintain stability of the angular position of normal operation of the pivoting sector. The central shaft 32 (shown in FIG. 7) is adapted to carry a resilient stop-blade 114 which is intended to return the pivoting sector 98 to the normal operating position after it may have been placed in the multiple-extraction position as will become more readily apparent from the explanation given below in connection with the operation of the apparatus.

The hub 97 of the pivoting sector 98 is pierced by a radial bore 107 which communicates with a radial bore 109 of the pivot 96 when the pivoting sector is in the multiple-extraction position. Said radial bore 109 opens into an axial bore 110 of said pivot which in turn communicates with the axial bore 64A of the tubular shaft 64 which carries the extracting head.

In that portion of the cylindrical surface of the column 57 which is located opposite to the pivoting sector 98, there is formed a radial bore 116 which communicates with an axial duct 117 of said column, said duct being closed at both ends and in turn adapted to communicate with an additional radial duct 118 of the circular turntable 49. In the wall of the stationary central shaft 32, there is formed a radial bore 119 which opens into the vacuum inlet duct 92.

The radial bores 89 and 119 of the stationary central shaft 32, the radial bore 85 of the tubular shaft 64 of the extracting head as well as the radial bore 107 of the pivoting sector 98 constitute means for switching the pneumatic circuits of the apparatus. It is only for the sake of enhanced clarity of presentation that these switching means have all been drawn in the plane of the figure since they are actually located in different geometrical planes.

A retaining pusher 123 is located in front of the discharge end of the bank-bill magazine 3 (as shown in FIG. 1), the end of said pusher being intended to bear against the stack of bank-bills remaining within the magazine under the action of a spring 124. Said pusher is designed in the form of an elbowed lever pivotally mounted on a stationary horizontal pin 125 and is held away from the rotating zone of the circular turntable 31 under the action of the tractive force exerted by a cable 127, one end of which is attached to an extension of said pusher and which passes over two guide pulleys 128, 129. The other end of said cable is attached to one of the arms 132 of a bell-crank lever 133 which is pivotally mounted on a stationary pin 139. The other arm 134 of said bell-crank lever is adapted to carry a roller 135 which is maintained in contact against a cam 137 under the action of a spring 136. Said cam is keyed on a shaft 138 which can be driven in rotation from an electric motor 141 by means of a transmission system represented schematically by a drive belt 142.

The bill-distributing mechanism 4 essentially comprises a clamp 151 and two exit rollers 152, 153 between which the bank-bills are discharged. The clamp 151 is composed of a stationary jaw 155 rigidly fixed to an arm 156 and of a movable jaw 157 which is capable of sliding along the arm 156 so as to clamp the bank-bills against the stationary jaw 155 under the action of an electromagnet 158 which is supplied by an electric circuit 161 comprising an electric contact 162 actuated by a cam 163 carried by the shaft 138. The arm 156 is pivotally mounted on a pin 166 carried by the plate 11 and is provided with an arm 167, the end of which carries a roller 168 which is applied in contact with a cam 173 under the action of a restoring spring 169, said cam being also keyed on the shaft 138. Thus the arm 156 undergoes a displacement between a bill-extracting position and a position shown in FIG. 1 for engagement of bank-bills between the exit rollers 152, 153, the movement of rotation of which is also carried out under the action of the motor 141 by means of a transmission system shown diagrammatically in the drawings in the form of a drive belt. For the purpose of counting one bank-bill, the circular turntable 49 performs exactly one full revolution and will therefore have to complete ten revolutions in order to count ten bank-bills. For the purpose of group distribution of these ten bills by means of the clamp 151 and the exit rollers 152, 153, the shaft 158 will have to perform one complete revolution.

The operation of that portion of the machine which has been described thus far can already be explained.

It is assumed that the magazine 15 is packed with bank-bills 5 and that it is desired to distribute these latter in sets of ten bills, for example.

Figure 9:
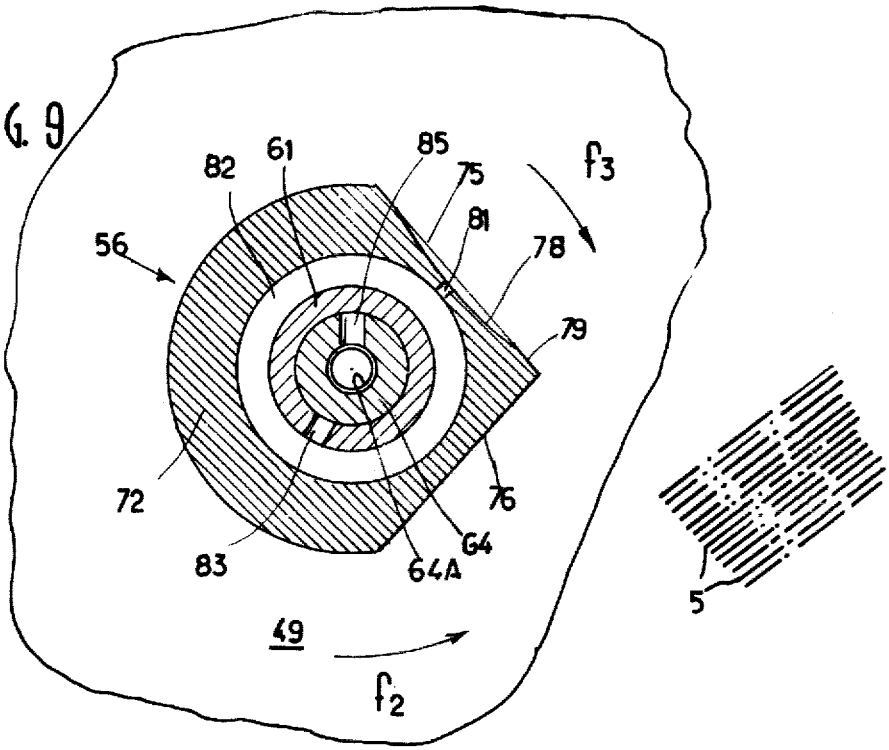
FIG. 9 is a fragmentary cross-sectional view of the extracting head which is also taken along line IV—IV of FIG. 3 but in which it has been assumed that the head is placed in its reference position, as well as the ducts and switching holes.
Figure 10:
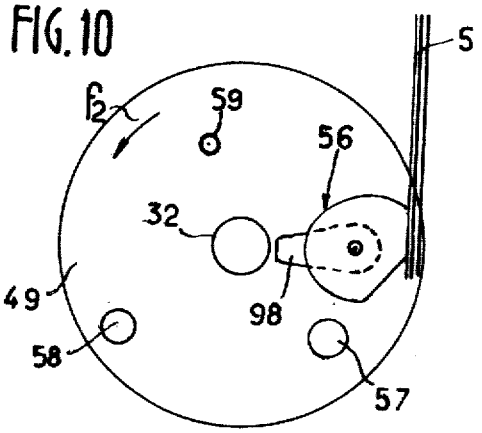
FIGS. 10 to 13 show the positions of the circular turntable and of the extracting head during the main stages of a counting cycle.
Figure 11:
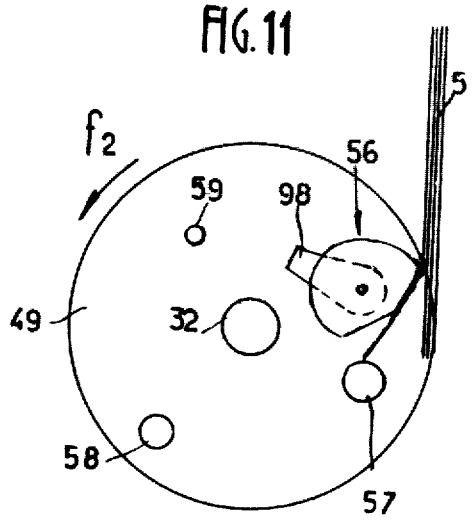
Figure 12:
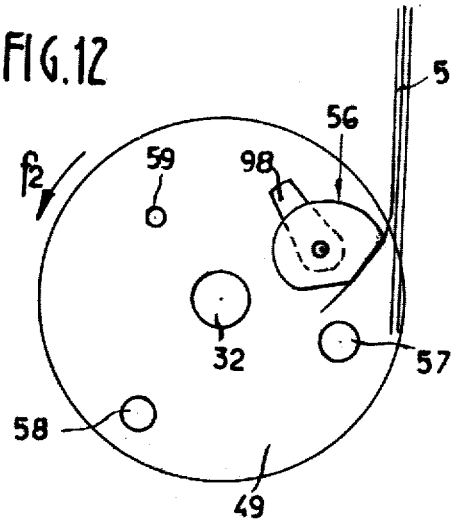

By automatic means which will be described hereinafter, the machine is put into operation or, in other words, the circular turntable 31 begins to rotate in the direction of the arrow $f_2$, starting from its reference position shown in FIG. 1 in which the pusher 123 and the clamp-supporting arm 156 are withdrawn from said turntable. When the circular turntable 31 reaches the angular position shown in FIG. 10, the extracting head 56 is applied against the stack of bank-bills 5 through the delivery opening of the magazine 3; the partial vacuum produces action through the drilled holes 81 of said head since the radial duct 83 of this latter is located at this moment opposite to the radial duct 85 of the tubular shaft 64 and the duct 88 of the circular turntable 49 is located opposite to the bore 89 of the stationary central shaft 32, with the result that a communication is established between the holes of the extracting head and the vacuum pump 38. The suction thus produced converts the extracting head to a suction element which adheres to the first bank-bill 5 of the stack of bills which are present within the magazine. The circular turntable continues to rotate in the direction of the arrow $f_2$ while the extracting head 56 rotates on the turntable at an angular velocity which is three times greater and in the opposite direction f3, with the result that said extracting head detaches the first bank-bill from the stack as shown in FIG. 9 in a kind of unrolling movement without sliding against the stack. FIG. 12 illustrates a slightly more advanced stage after which the partial vacuum within the extracting head may be stopped if necessary in view of the fact that, if the bank-bill becomes detached from the extracting head and tends to return to its initial position within the magazine, it will encounter the column 57 carried by the circular turntable, with the result that the bill is trapped between the extracting head and said column. While the turntable continues to rotate, the column 57 brings the bank-bill to the position shown in dashed lines at 5A in FIG. 1, whereupon the other columns hold the bill in this position as they pass during completion of the revolution of the turntable. The entire range of travel of the turntable in rotational motion from the position shown in FIG. 11 is utilized for safety control purposes which will be explained below.

When it has performed one complete revolution, the circular turntable has therefore counted one bank-bill. The automatic control means to which further reference will be made later on in the description cause said turntable to perform a number of revolutions corresponding to the number of bank-bills required by the user, namely ten bills in the example under consideration. In consequence, ten bills are now presented in the position shown in FIG. 1 at 5A. In other words, approximately one-half of the length of said bills is still trapped against the exit end-wall 18 of the magazine whilst the other half is folded-back at right angles towards the exterior. The motor 141 is then started up, thus causing pivotal motion of the clamp-supporting arm 156 towards the group of counted bank-bills under the action of the cam 173, closure of the clamp 151 against the bills under the action of the cam 163 which produces excitation of the electromagnet 158, application of the pusher 123 against the stack of bills remaining within the magazine in order to release the counted bills under the action of the cam 137, of the cable control 127 and of the spring 124, followed by pivotal displacement of the clamp-supporting arm 156 in the other direction, namely in the direction of the arrow $f_4$ in order to engage the counted bills between the exit rollers 152, 153. Said rollers which are driven in rotation by the motor 141 consequently grip the ten counted bills and distribute them to the user. All the elements of the distributing mechanism 4 have returned to their reference position shown in FIG. 1 and the circular turntable 49 which had already been stopped at the end of the cycle is also in its reference position.

By reason of the fact that the number of bank-bills actually distributed to the user is governed by a counter which records the number of revolutions performed by the circular turntable 31, it is essential to ensure that, at each revolution of the counter, one and only one bank-bill is actually brought to the position 5A in which it is presented to the clamp 151.

To this end, the machine comprises two successive checking means for making sure that the extracting head 56 has in fact gripped at least one bank-bill and one checking means for making sure that said head has not taken more than one bill. Moreover, the machine further comprises control means for determining at each revolution of the circular turntable whether said checking means operate correctly.

The first means for checking effective extraction of at least one bank-bill operates on the following principle: during the time taken for this extraction or, in other words, during the time taken for the circular turntable to undergo a displacement from its reference position through an angle within the range of 34° to 85° (see the chronogram of FIG. 16), the drilled holes 81 of the extracting head communicate with the vacuum inlet duct 92, especially through the bore 89 of the central shaft, the duct 88 of the circular turntable being located opposite to said bore at this instant, as indicated in the chronogram on the line corresponding to "Turntable" at "89 open". In consequence, if the extracting head has in fact gripped one bank-bill (or a number of bills), its holes are closed-off by said bill and the partial vacuum is maintained within the vacuum inlet duct. On the contrary, if the extraction has failed to take place or, in other words, if the head has not gripped any bill, the duct 83 can be considered as open as indicated in the chronogram and atmospheric air penetrates into the holes of the extracting head. In consequence, the pressure rises within the vacuum inlet duct 92 as shown on the line corresponding to "Head" of the chronogram between the angles 34° and 85°, the pressure transducer 42 is actuated and indicates the operational fault (see the line of the chronogram corresponding to "Pressure transducer") which will be utilized as explained below.

Figure 13:
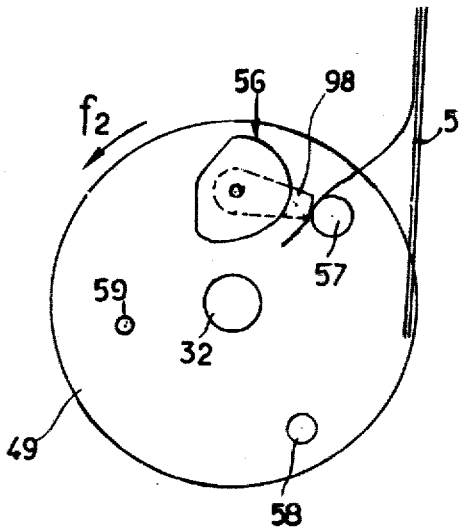
Figure 16:
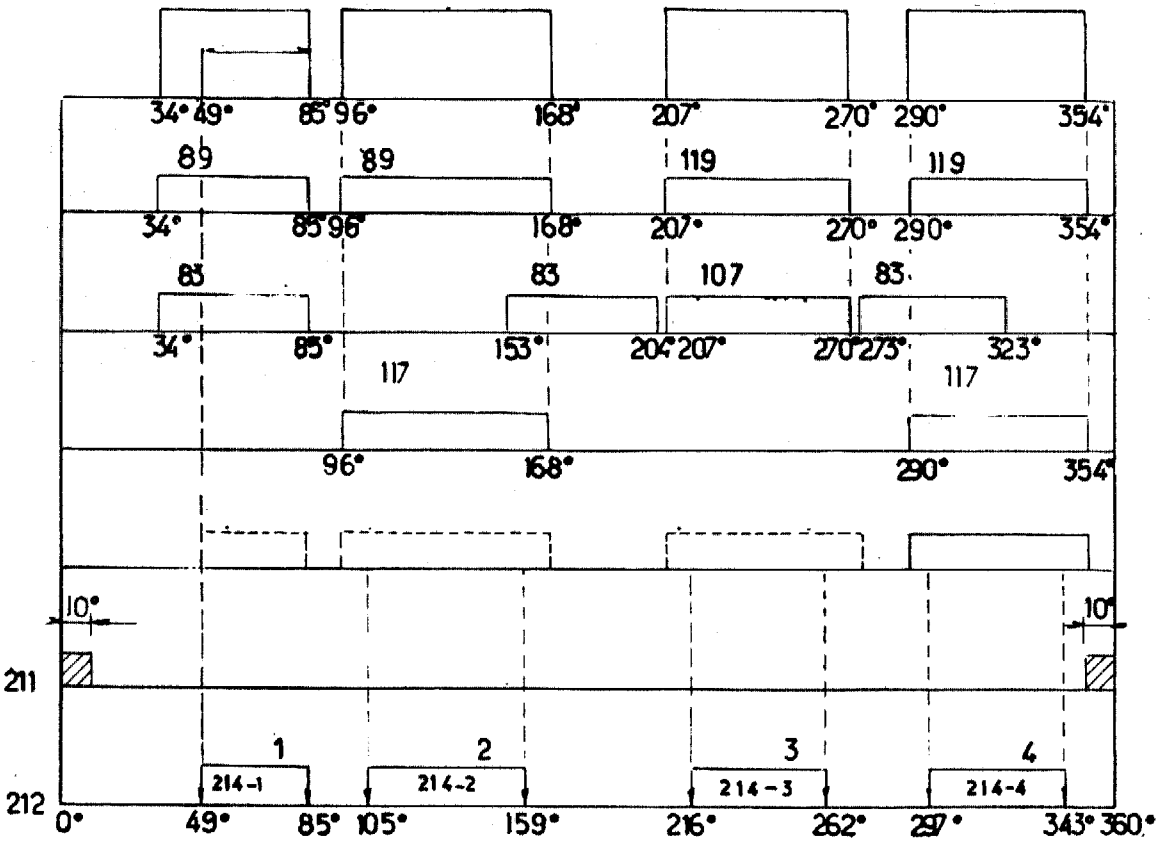
FIG. 16 is a chronogram which illustrates the operation of the machine during one counting cycle.

The second means for checking effective extraction of at least one bank-bill operates on the following principle: while the circular turntable undergoes a displacement through an angle within the range of 96° to 168° in the vicinity of the position shown in FIG. 13 in which the circular sector 98 carried by the extracting head 56 passes at a distance from the column 57 equal to the thickness of a bank-bill. The bill which is in process of being counted is therefore in contact with the edge of the bore 116 of said column; at the same time, the additional duct 118 of the circular turntable is located opposite to the radial bore 89 of the stationary central shaft 32 as indicated by "89 open" on the "Turntable" line of the chronogram (FIG. 16). In consequence, the holes of the column are in communication with the vacuum inlet duct 92. Thus, when a bank-bill is normally present against the column, it closes-off the bore 116 of said column and the vacuum is maintained within the vacuum inlet duct. On the contrary, if there is no bank-bill against the column, atmospheric air penetrates into the bore 116 and reaches the vacuum inlet duct 92 in which the pressure rises again as shown in the chronogram on the "Column" line within the range of 96° to 168°; this has the result of actuating the pressure transducer 42 (see "Pressure transducer" line of the chronogram), the information delivered by said transducer being utilized in the same manner as in the previous instance. In order to ensure that the atmospheric air may be permitted to pass without difficulty between the cylindrical surface of the column 57 and the cylindrical surface of the circular sector 98, this latter is provided with an annular channel 98A (as shown in FIG. 3).

In order to carry out a checking operation and to make sure that the extracting head has not gripped more than one bank-bill, advantage is taken of the fact that the circular sector 98 carried by the extracting head is pivotally mounted. It has been mentioned earlier that the radius of said circular sector is equal to the distance between its geometrical axis and the cylindrical surface of the column 57, increased by a value comprised between the thickness of a single bank-bill and the sum of thicknesses of two bills. In consequence, if the head has gripped a single bill, the sector simply slides against the bill and remains in its normal and stable angular end-position in which it is maintained by the magnet 105. This period of operation takes place at the same time as the above-mentioned checking of the presence of a bill.

At a much later stage and in the case of a rotational displacement of the circular turntable between the angles 207° and 270° (again starting from its zero position), the duct 88 of the circular turntable is located opposite to the radial bore 119 of the stationary central shaft 32 as designated by "119 open" on the "Turntable" line of the chronogram; in other words, the axial duct 64A of the head-carrying tubular shaft is in communication with the vacuum inlet duct 92. However, since the radial bore 109 of the pivot 96 which is rigidly fixed to said shaft is not located opposite to the radial bore 107 of the hub 97 of the sector 98 at this moment, the atmospheric air cannot reach the vacuum inlet duct 92 via said bore 107. The pressure does therefore not rise within said inlet duct, with the result that the pressure transducer 42 is not actuated, which corresponds to normal operation of the machine.

On the contrary, if the head has gripped a number of bills (this condition being designated as "multiple extraction"), said bills are thus clamped between the cylindrical surface of the column 57 and the circular sector 98, with the result that said sector can no longer continue to rotate with respect to the circular turntable. However, since the head rotates continuously with respect to said turntable, the pivot 96 of the sector will also rotate and its radial bore 109 will come opposite to the radial bore 107 of the sector hub; this condition has been designated as "107 open" on the "Head" line of the chronogram of FIG. 16. An increase in pressure will therefore takes place immediately within the vacuum inlet duct 92 and cause actuation of the pressure transducer 42 (see "Pressure transducer" line of the chronogram within the range of 207° to 270°) which will accordingly indicate the fault.

It has also been mentioned earlier that the circular sector is displaced slightly off-center (by a quantity "e" in FIG. 3) with respect to the extracting head. The purpose of this eccentric displacement is to allow the sector to move away from the column 57 to a very slight extent as soon as it first comes into contact with the overthickness caused by the presence of one or more bills taken in too great a number by the head in order to guard against any danger of either damage or deformation of the mechanism.

The means for determining at each revolution of the circular turntable whether the aforementioned checking means operate correctly consist in making sure that the bore 116 of the column 57 is not obstructed as indicated by the presence of a pressure rise within the vacuum inlet duct 92 during the period corresponding to the last portion of the revolution of the turntable, namely between the angles 290° and 354° by reason of the fact that, during this period, the duct 118 of the circular turntable is in communication with the radial bore 119 of the stationary central shaft 32. In the chronogram of FIG. 16, it has been indicated within the range of 290° to 352° on the "Turntable" line that the bore 119 is open on the "Column" line, that the duct 117 of the column 57 is open at each revolution and that, on the "Pressure transducer" line the pressure rises if the good operation test is positive.

The occurrences which give rise to each operational fault mentioned in the foregoing will now be considered.

If the head fails to extract a bill, the circular turntable completes its revolution without incrementing the counter, then begins another revolution. If the extraction takes place correctly in this case, the process continues normally. On the contrary, if the extraction again fails to take place, the machine can be programmed for one or a number of attempts; but if such attempts prove to be of no avail, the machine is withdrawn from service after returning to the magazine all bank-bills which have already been counted prior to occurrence of the fault condition. This return of bank-bills is carried out by means of a backward movement of rotation of the circular turntable after completion of the last revolution. Bills which have already been counted, or in other words those located in position 5A in FIG. 1, pass between the columns 58 and 59 under the action of their inherent elasticity, with the result that the column 58 brings them back against the stack of bills which have remained within the magazine. It should be recalled that only about one-half of the length of the bills already counted had been withdrawn from the magazine whilst the other half had remained applied against the internal face of the delivery end-wall of the magazine, thus facilitating their complete return. All the machine components are therefore restored to their reference positions and there is no bill outside the magazine.

If the presence of a bank-bill against the column 57 is not observed during the second checking operation contemplated by the invention, then the procedure is the same as in the case of a "missed" extraction.

Figure 7:
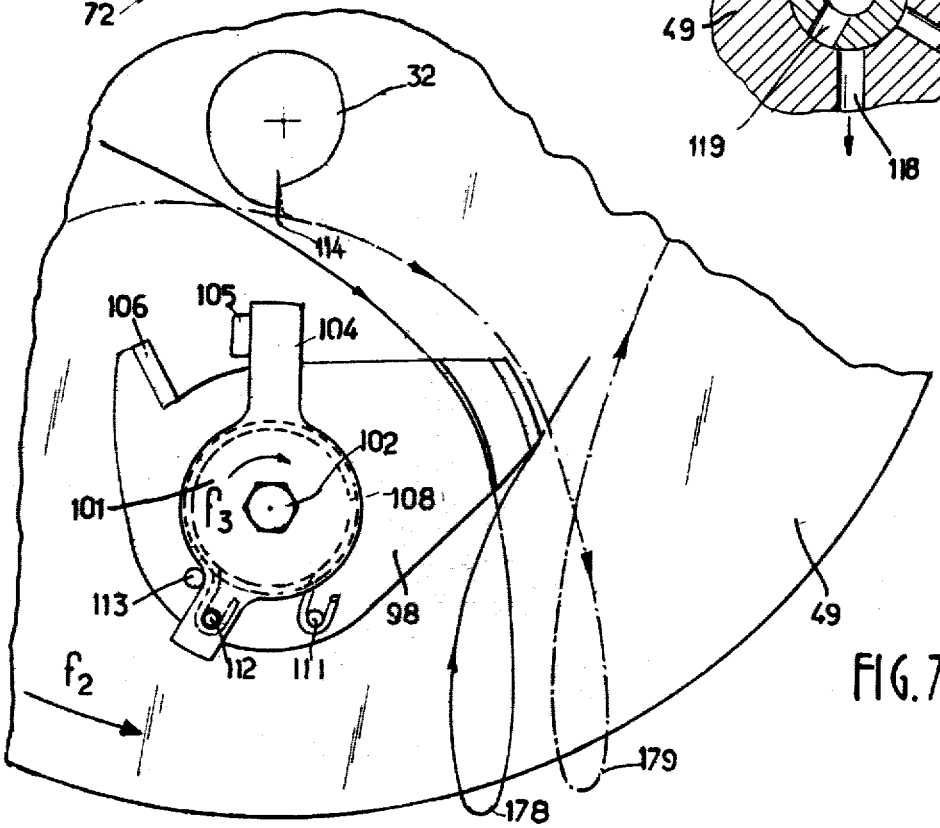
FIG. 7 is a view which is similar to FIG. 6 but after the head has performed a multiple extraction and which shows at the same time the means for returning the head to the normal position.

If a multiple extraction is detected, the circular turntable again completes its revolution, then moves backwards for one or a number of attempts or else the procedure of readmission of bank-bills to the magazine is initiated under the conditions which have just been explained in connection with a missed extraction. Furthermore, it is while the circular turntable performs a backward revolution that the pivoting sector 98 reverts to its normal and stable operating angular position from which it had been displaced under the action of the multiple extraction. When said sector is located in its multiple-extraction information position as shown in FIG. 7, the cylindrical portion of said sector describes the spatial path 179 and consequently comes up against the resilient stop-blade 114 during withdrawal of the circular turntable in the direction opposite to the arrow $f_2$. Progressively as the combined rotation of the turntable and of the sector takes place, the pallet 106 draws nearer to the magnet 105, that is, towards the position of resetting of the sector. Said sector then moves away from the blade 114 and, under its own impetus, causes the magnet to come into contact. Thereupon, the cylindrical surface of the pivoting sector follows the spatial path 178 (in the direction opposite to the arrows indicated in FIG. 7) which passes close to the blade 114. In other words, the sector moves away from said blade when it is located in the stable and angular position of normal operation. (It should be noted that, even in the stable position of detected multiple extraction, the sector is capable of passing in the vicinity of the shaft 32 in the normal direction of rotation $f_2$, simply by deflecting the blade 114 which transiently assumes the configuration shown in chain-dotted lines in FIG. 7).

Figure 14:
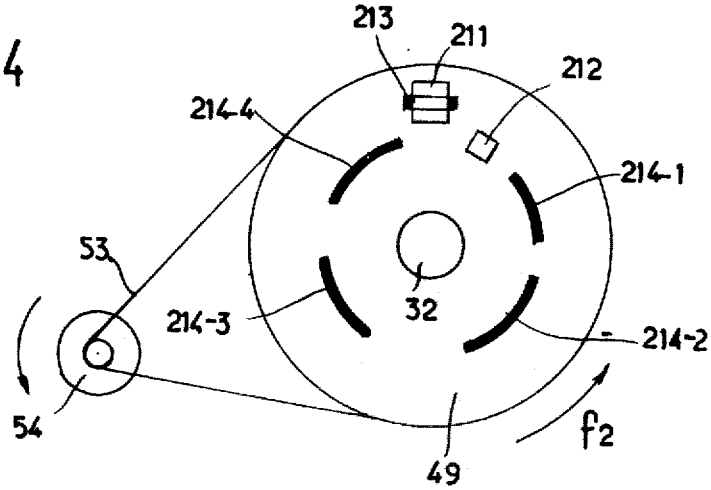
FIG. 14 is a sectional view taken along line XIV—XIV of FIG. 3 and showing the control cells.
Figure 15:
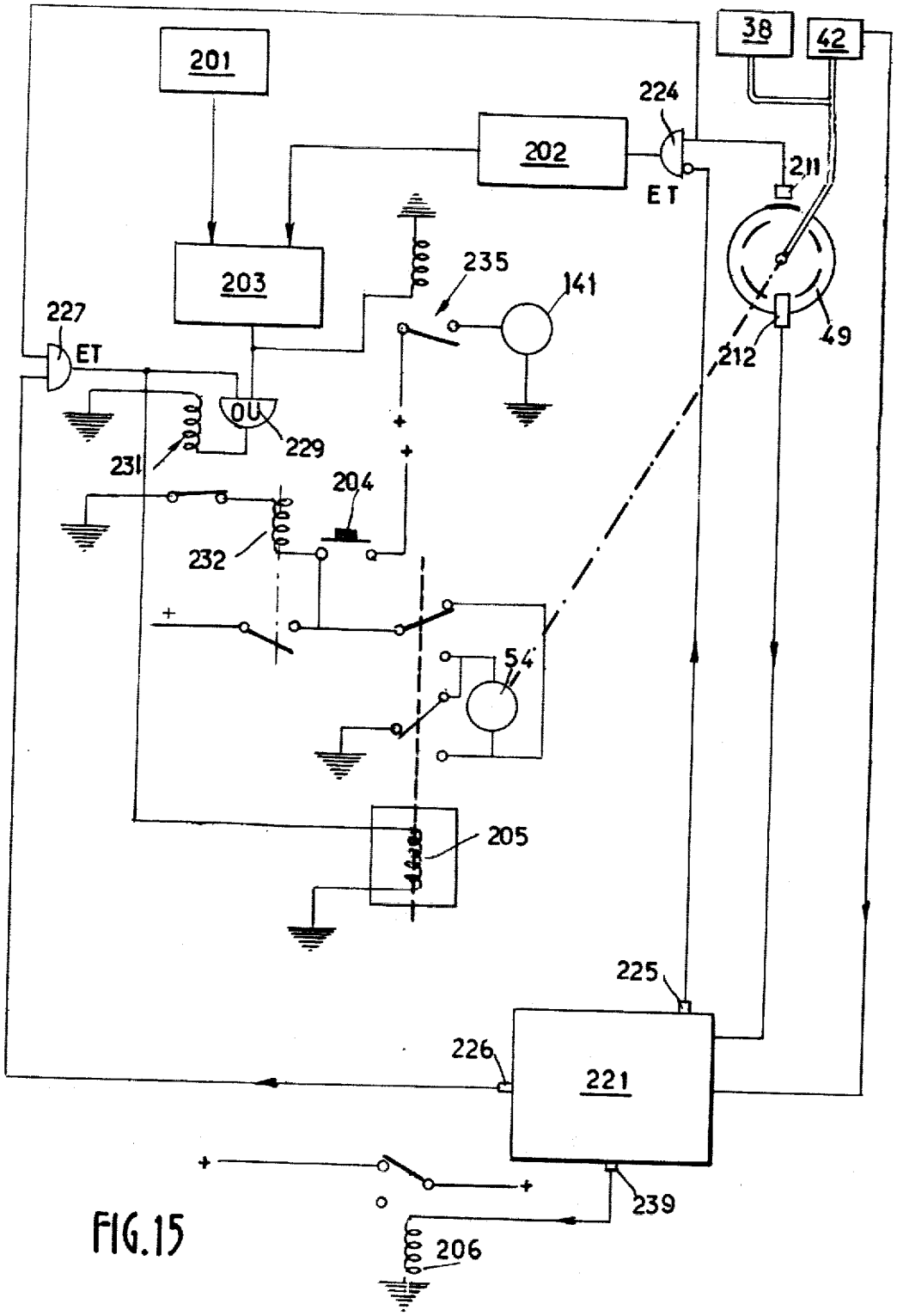
FIG. 15 is a general circuit diagram of the machine.

Referring now to the general electric circuit diagram of FIG. 15, the automatic operation of the machine will now be briefly described. There are again shown in this diagram the circular turntable 49, the electric motor 54 for driving said turntable in rotation, the electric motor 141 for driving the bill-distributing mechanism 4, the pump 38 and the pressure transducer 42. In this diagram there are also shown a programming keyboard 201, a counter 202, a comparator 203 which receives information from the keyboard and from the counter, a start-up push-button 204, a relay 205 for reversing the direction of rotation of the motor 54 which drives the turntable, and a cut-out switch 206 for interrupting the general power supply to the machine as a whole. Two photoelectric cells 211, 212 (also shown in FIGS. 3 and 14) are placed in fixed locations in the vicinity of the surface of the turntable 49. Said photoelectric cells serve, for example, to scan a bright portion of said surface on which two coaxial tracks are painted in a matt black finish. The first rack is constituted by an arc 213 of short length corresponding to an angle of 10° about the angular reference position of the circular turntable as shown in the lower portion of the chronogram of FIG. 16 on the line entitled "Cell 211". The other track is composed of four arcs 214-1, 214-2, 214-3, 214-4 which correspond to emission of four time-marker pulses numbered from 1 to 4 on the last line of the chronogram opposite to the ranges of corresponding angles marked on this line. These four pulses correspond respectively to the effective extraction test, to the bill presence test, to multiple-extraction detection, and to the good-operation test.

The cell 212 and the pressure transducer 42 are connected to a fault detector 221, the truth table of which is as follows:

| Cell 212 | Pressure transducer 42 | Result | State of corresponding output |
|---|---|---|---|
| Pulse No 1 | AND contact | Missed extraction | High state |
| Pulse No 2 | AND contact | Absent bank-bill | High state |
| Pulse No 3 | AND contact | Multiple extraction | High state |
| Pulse No 4 | AND contact | Correct pneumatic circuit | Low state |

Entry to the counter 202 is via an AND-cell 224, one input of which is connected to the photoelectric cell 221 and the other input of which is connected to an output 225 of the fault detector relating to missed extractions or to absences of bank-bills detected during the revolution of the circular turntable; this output emits a signal when neither of these faults exist. The fault detector 221 also has an output 226 relating to multiple extractions connected to one of the inputs of an AND-cell 227, the other input of which is connected to the photoelectric cell 211. The output of said AND-cell is connected to a first input of an OR-cell 229, the other input of which is connected to the output of the comparator 203. The output of the OR-cell serves to supply current to the coil of a relay 231, the normally-closed contact of which is placed in the supply circuit of a relay 232, the normally-open contact of which serves to maintain the supply of the motor 54 for driving the circular turntable as a result of pressure exerted on the start-up push-button 204. The output of the comparator 203 is also connected to the coil of a relay 235, the contact of which serves to close the supply circuit of the motor 141 of the bill-distributing mechanism. Finally, the switching relay 205 is controlled by the output of the cell 227.

The operation of the automatic installation is as follows. The user programs the number of bank-bills to be distributed on the keyboard 201, then depresses the start-up push-button 204, the contact of the maintaining relay 232 closes and the motor 54 drives the circular turntable 49 in rotation, said turntable being scanned by the two cells 211, 212. At each revolution of the turntable, one bill is counted as explained earlier. At the same time, the cell 211 transmits a time-marker pulse at each revolution to the counter input AND-cell 224. If the operation takes place in the normal manner, the other input of said AND-cell does not receive any pulse from the output 225 of the fault detector, the counter 202 is incremented by one unit and transmits a pulse to the comparator 203. At the instant at which the number of bills counted is equal to the number of bills required, the comparator delivers a high output to the input of the OR-cell 229, thus opening the contact of the relay 231; said relay in turn cuts-off the maintaining relay 232 and the motor 54 consequently stops. At the same time, the signal emitted at the output of the comparator 203 causes excitation of the relay 235 which initiates one cycle of operation of the motor 141 of the bill-distributing mechanism 4 comprising the clamp 151 and the rollers 152, 153 (shown in FIG. 1). The machine is in readiness for a further distribution.

If one extraction fails to take place or if a bank-bill absence is detected, the output 225 of the fault detector 221 emits a signal (see truth table). As a result of the NOT function at the input of the AND-cell 224, said cell is not in the conducting state, the counter 202 is not incremented and the circular turntable will be driven in rotation for one further revolution.

On the contrary, if a multiple extraction takes place, the output 226 of the fault detector 221 transmits a signal to the AND-cell 227 which receives a pulse from the photoelectric cell 221 at the end of the revolution of the turntable and becomes operative, thus initiating the delivery of a signal from the OR-cell 229 which then causes the motor 54 to stop in accordance with the process explained earlier and under the same conditions as if the OR-cell 229 had received a signal from the comparator 203 at the end of a correct counting operation. The switching relay 205 is excited by the high output level of the AND-cell 227; the motor 54 which is controlled by an electronic system (not shown in the figure) drives the turntable in reverse motion for one revolution, thus recycling the multiple bank-bills into the magazine.

Finally, if the pneumatic circuit is not correct, a signal derived from another output 239 of the fault detector 221 has the effect of tripping the circuit-breaker 206 and this latter cuts-off the general power supply to the machine which is thus deliberately withdrawn from service.

What is claimed is:

1. A device for counting sheets and especially bank-bills, and comprising:

a magazine in which the sheets are placed against each other so as to form a stack;

a circular turntable rotatably mounted in proximity to said magazine about an axis parallel to the plane of the sheets within the magazine;

a sheet-extracting head rotatably mounted on said circular turntable in the vicinity of the periphery of this latter about an axis parallel to that of said turntable;

means for driving the circular turntable in rotation in a first direction;

means for driving the extracting head in rotation with respect to the turntable in the other direction;

and means for counting the number of revolutions performed by the circular turntable;

drilled holes being formed in an extracting face of said sheet-extracting head and connectable to a vacuum source by means of ducts connected to each other and formed respectively in said extracting head, in the shaft which carries said head, in the circular turntable, and in a vacuum inlet duct formed in a stationary member which is adjacent to said turntable;

wherein the rotary circular turntable which is adapted to count one sheet per revolution also carries a plurality of columns in the vicinity of its periphery and wherein the counting device aforesaid further comprises a first safety device for producing a signal at each revolution of the turntable if and when the extracting head has taken more than one sheet, and a second safety device for checking at each revolution of the turntable whether the extracting head has in fact taken at least one sheet, said first safety device being provided with a circular sector pivotally mounted on the extracting head and having a radius equal to the distance between its geometrical axis and the cylindrical surface of the next column on the circular turntable increased by a value ranging between the thickness of a single sheet to be counted and the sum of thicknesses of two sheets, means for placing said sector in two stable angular end-positions with respect to the extracting head, namely a normal operating position and a multiple-extraction information position, means whereby the stable state of normal operation and the stable state of multiple extraction of said sector are checked at each revolution of the circular turntable, as well as means for restoring said sector to the stable position of normal operation after any transfer of said sector to the stable position of multiple-extraction information.

2. A device according to claim 1, wherein said means for placing the sector in two stable angular end-positions with respect to the extracting head are constituted by a permanent magnet carried by one of these two components and adapted to cooperate with a portion of the other component, and by a spring which couples said two components and the force of which is lower in value than the attractive force of the magnet.

3. A device according to claim 1, wherein the means for checking the stable state of normal operation and the stable state of multiple-extraction information of the pivoting sector at each revolution of the circular turntable comprise a bore formed in said sector and a corresponding bore formed in the extracting head so as to communicate with the duct formed in the shaft which carries said head, the two bores aforesaid being located in opposite relation when the pivoting sector occupies its stable angular end-position of multiple-extraction information, as well as means responsive to variations in partial vacuum within the vacuum inlet duct and means for reading said means which are responsive to variations in partial vacuum, said reading means being activated at the moment of engagement of the pivoting sector against the cylindrical surface of the next column on the circular turntable.

4. A device according to claim 1, wherein the second safety device for checking whether the extracting head has taken at least one sheet at each revolution of the circular turntable comprises means responsive to variations in partial vacuum within the vacuum inlet duct, communication means adapted to establish a temporary communication between the duct formed in the circular turntable and the vacuum inlet duct during the period in which the extracting head should be in contact with a sheet to be counted, and means for reading said means which are responsive to variations in partial vacuum, said reading means being activated during said period.

5. A device according to claim 1, wherein the second safey device for checking whether the extracting head has taken at least one sheet at each revolution of the circular turntable comprises means which are responsive to variations in partial vacuum within the vacuum inlet duct, a bore which is formed in the cylindrical surface of the next column aforesaid on the circular turntable and which communicates with the vacuum inlet duct during the period in which a sheet is normally applied against said bore of the column, via an axial duct of said column, via an additional duct formed in the circular turntable, and via switching means for establishing a temporary communication between said additional duct formed in the circular turntable and the vacuum inlet duct during the period of counting of a sheet which should be engaged against said bore of the cylindrical surface of the next column aforesaid, and means for reading said means which are responsive to variations in partial vacuum, said reading means being activated during said period.

6. A device according to claim 5, wherein said device comprises means for determining the good state of the device in which means are provided for reading said means which are responsive to variations in partial vacuum, said reading means being activated during a period in which the circular turntable is about to complete a full revolution, the structure of the switching means being such that a communication is then established between said ducts and that the partial vacuum maintained therein must then be normally of very low value.

7. A device according to claim 1, wherein the stationary element which is adjacent to the circular turntable and in which is formed the vacuum inlet duct is a shaft on which said circular turntable is rotatably mounted.

8. A device according to claim 7, wherein the switching means aforesaid are constituted by bores formed in the stationary shaft opposite to the ducts formed in the circular turntable.

9. A device according to claim 1, wherein the means for driving the extracting head in rotation with respect to the circular turntable are constituted by a pinion rigidly fixed to said head and engaged with a stationary toothed ring which is coaxial with said turntable.

10. A device according to claim 1, wherein the means for restoring the circular pivoting sector to the stable position of normal operation after any changeover to a stable position of multiple-extraction information consist of a stationary boss which is encountered by said sector only in the multiple-extraction information position.

* * * * *